US012139895B2

(12) United States Patent
Yang et al.

(10) Patent No.: US 12,139,895 B2
(45) Date of Patent: Nov. 12, 2024

(54) INDUCTION TYPE PULLING FAUCET

(71) Applicant: Kaiping Aidier Sanitary Ware Co., Ltd., Kaiping (CN)

(72) Inventors: Chunlu Yang, Shangrao (CN); Zhiyang Chen, Fuzhou (CN)

( * ) Notice: Subject to any disclaimer, the term of this patent is extended or adjusted under 35 U.S.C. 154(b) by 232 days.

(21) Appl. No.: 17/984,427

(22) Filed: Nov. 10, 2022

(65) Prior Publication Data

US 2024/0018759 A1 Jan. 18, 2024

(30) Foreign Application Priority Data

Jul. 13, 2022 (CN) ..... 202210819222.0

(51) Int. Cl.
*E03C 1/04* (2006.01)
*E03C 1/02* (2006.01)
*E03C 1/05* (2006.01)

(52) U.S. Cl.
CPC ..... *E03C 1/0405* (2013.01); *E03C 1/057* (2013.01); *E03C 2001/026* (2013.01); *E03C 2001/0415* (2013.01)

(58) Field of Classification Search
CPC ..... E03C 1/0404; E03C 1/0405; E03C 1/057; E03C 1/04; E03C 2001/026; E03C 2001/0415; F16K 11/22; F16K 11/24; F16K 31/02; F16K 31/0675; F16K 31/3516
See application file for complete search history.

(56) References Cited

U.S. PATENT DOCUMENTS

2006/0130907 A1* 6/2006 Marty ..... E03C 1/057 137/613
2006/0202142 A1* 9/2006 Marty ..... E03C 1/055 251/129.04
2013/0248617 A1* 9/2013 Sawaski ..... E03C 1/0404 239/73
2015/0292187 A1* 10/2015 Tseng ..... E03C 1/0412 4/677
2017/0101766 A1* 4/2017 Blizzard ..... F16K 21/16
2017/0198460 A1* 7/2017 Kamata ..... E03C 1/057

* cited by examiner

*Primary Examiner* — Patrick C Williams
(74) *Attorney, Agent, or Firm* — Sandy Lipkin

(57) ABSTRACT

The present invention relates to technical field of faucet, specifically to an induction type pulling faucet, including a faucet body, a valve core, a handle, and a pulling shower head. A water inlet tube, a pulling tube, and an induction control valve are mounted in the faucet body. The pulling tube is connected to pulling shower head and valve core respectively. The valve core is connected to water inlet tube and the handle respectively. An infrared sensor and a magnetic sensor are mounted in faucet body, which are both electrically connected to the induction control valve via electric wire. A strong magnet is mounted in the pulling shower head. The present invention identifies magnetic field changes between the pulling tube and the pulling shower head by setting magnetic sensor to achieve induction control of water path switch, and increase convenience of using the induction type pulling faucet.

6 Claims, 3 Drawing Sheets

INDUCTION TYPE PULLING FAUCET

REFERENCE TO PRIOR APPLICATION

This application claims priority to Chinese Patent Application 202210819222.0, filed on Jul. 13, 2022, which is incorporated herein by reference.

TECHNICAL FIELD

The present invention relates to the technical field of a faucet, and particularly to an induction type pulling faucet.

BACKGROUND

A faucet, commonly known as a water valve, is a switch configured to control a size of water flow, and has a function of saving water. Upgrading of the faucet is very fast, from an old cast iron process to an electroplating knob type faucet, and then to a stainless steel single-temperature single-control faucet, a stainless steel double-temperature double-control faucet, and a kitchen semi-automatic faucet. At present, an induction type pulling faucet in a faucet industry is not connected to an elbow tube portion and a front end of a pulling tube of a faucet by using an infrared sensor on a main body. Through a change in a magnetic field between moving distances of the elbow tube portion and the pulling tube, dual-use induction and control of a manner of a water path switch is realized on the same pulling faucet. A practitioner hopes to achieve this control mode. Further, for the pulling faucet in the prior art, a shower head is pulled and pressed at an elbow tube port via a heavy vertical block on the pulling tube. To achieve induction and water discharge by a magnetic field, a strong magnet and a sensor need to be mounted cooperatively. However, if the strong magnet is mounted in a middle of the pulling tube, because of strong pulling of the heavy vertical block, the pulling tube passively becomes longer, or because of thermal expansion and cold shrinkage caused by temperature change, if a change in a relative position between the strong magnet and the sensor is more than a moving distance of the sensor, an erroneous action is caused.

SUMMARY

For the technical problem to be solved by the present invention, to overcome the above deficiencies in the prior art, the present invention provides an induction type pulling faucet, which induces, identifies and controls water outlet by setting an infrared sensor. Further, a magnetic sensor is arranged to induce and identify the change in a magnetic field between moving distances of a pulling tube and a pulling shower head, so as to achieve induction and control of a manner of a water path switch, and increase use convenience of the induction type pulling faucet.

In order to solve the above technical problem, the technical solution of the present invention is as follows:

An induction type pulling faucet includes a faucet body, a valve core, a handle, and a pulling shower head. A water inlet tube, a pulling tube, and an induction control valve are mounted in the faucet body. The pulling tube is connected to the pulling shower head and the valve core, respectively. The valve core is connected to the water inlet tube and the handle, respectively. An infrared sensor and a magnetic sensor are mounted in the faucet body. A strong magnet is mounted in the pulling shower head. The induction control valve is connected to the water inlet tube and the pulling tube, respectively. The infrared sensor and the magnetic sensor are both electrically connected to the induction control valve via an electric wire.

Preferably, the faucet body includes a faucet main body, a connector, and an elbow tube portion. An upper end of the faucet main body is connected to the elbow tube portion via the connector. A flat spacer and a tooth tube are sleeved on an outer side of a bottom of the faucet main body sequentially.

Preferably, an infrared induction window is arranged at a front end of the faucet main body. The infrared induction sensor is mounted in the infrared induction window. A valve core seat is arranged on the faucet main body. The valve core is mounted in the valve core seat. The handle includes a handle seat and a handle rod.

Preferably, an elbow tube port is arranged on the elbow tube portion. The magnetic sensor is mounted in the elbow tube port.

Preferably, the pulling tube includes a pulling braided tube, a pulling tube inner connector, and a pulling tube universal connector. The pulling tube inner connector is connected to the pulling braided tube and the pulling tube universal connector, respectively. The strong magnet is mounted on the pulling tube inner connector.

Preferably, the pulling shower head includes a shower head upper cover, a hydraulic generator, a shower head switching valve, a shower head water outlet cover, and a mesh tip. The shower head upper cover is connected to the pulling tube universal head. The hydraulic generator, the shower head switching valve, and the shower head water outlet cover are mounted in the shower head upper cover sequentially. The mesh tip is mounted at an inner side of the shower head water outlet cover.

Preferably, a gravity ball is sleeved on an outer side of a bottom end of the pulling tube. A pulling rubber sleeve is arranged at an inner side of the faucet main body.

Preferably, the hydraulic generator is electrically connected to the infrared sensor. The magnetic sensor, and the induction type control valve via the electric wire, respectively.

According to the above technical solution, the induction type pulling faucet provided in the present invention has the following beneficial effects: the pulling tube in the induction type pulling faucet is connected to the pulling shower head and the valve core, respectively. The valve core is connected to the water inlet tube and the handle, respectively. The infrared sensor and the magnetic sensor are mounted in the faucet body. The strong magnet is mounted in the pulling shower head. The induction control valve is connected to the water inlet tube and the pulling tube, respectively. The infrared sensor and the magnetic sensor are electrically connected to the induction control valve via the electric wire. The infrared sensor is arranged to induce, identify and control water outlet. Further, the magnetic sensor is arranged to identify a change in a magnetic field between moving distances of the magnetic sensor in the pulling tube and the strong magnet in the pulling shower head, thereby identifying a position of the pulling shower head, achieving the induction and control of the water path switch, and then controlling a manner of the water path switch of the induction type pulling faucet. Control methods are diversified. Use convenience of the induction type pulling faucet is increased. The induction type pulling faucet is more convenient to use. A blank of pulling induction control of the water path switch in the industry is filled. The user's satisfaction can be greatly improved with good experience.

Figure 1:
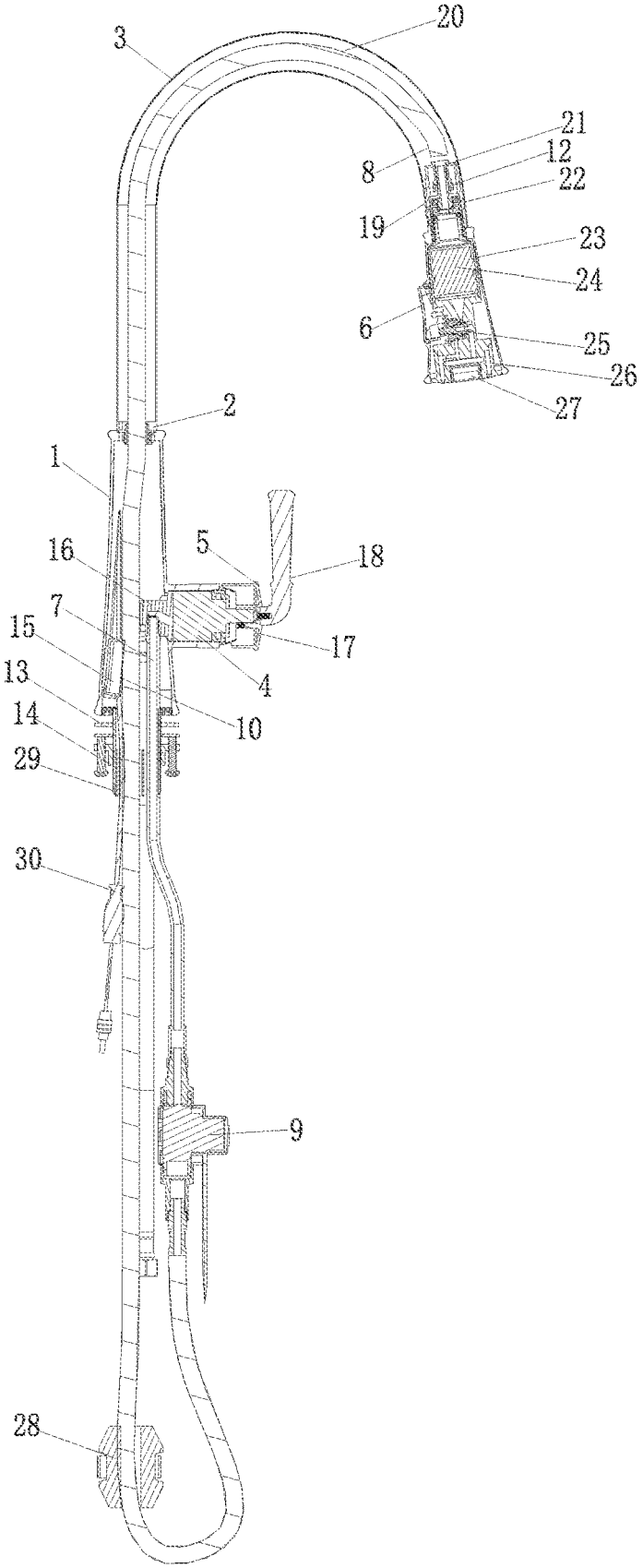
FIG. 1 is a cross-sectional view of the present invention.

In the figures, 1—faucet main body, 2—connector, 3—elbow tube portion, 4—valve core, 5—handle, 6—pulling shower head, 7—water inlet tube, 8—pulling tube, 9—induction control valve, 10—infrared sensor, 11—magnetic sensor, 12—strong magnet, 13—flat spacer, 14—tooth tube, 15—infrared induction window, 16—valve core seat, 17—handle seat, 18—handle rod, 19—elbow tube port, 20—pulling braided tube, 21—pulling tube inner connector, 22—pulling tube universal head, 23—shower head upper cover, 24—hydraulic generator, 25—shower head switching valve, 26—shower head water outlet cover, 27—mesh tip, 28—gravity ball, 29—pulling rubber sleeve, 30—electric wire.

DETAILED DESCRIPTION OF THE EMBODIMENTS

Specific embodiments of the present invention are further described below in conjunction with the drawings. It should be noted that the descriptions of these embodiments are used to aid in the understanding of the present invention, but do not make a limitation of the present invention. In addition, the technical features involved in various embodiments of the present invention described below can be combined with each other as long as the technical features do not conflict with each other.

In the description of the present invention, it should be understood that orientations or position relationships indicated by terms such as "center", "longitudinal", "lateral", "length", "width", "thickness", "above", "under", "front", "rear", "left", "right", "vertical", "horizontal", "top", "bottom", "inner", "outer", "clockwise", "counterclockwise", "axial", "radial", and "circumferential" are based on the orientations or position relationships shown in the drawings, are merely intended to describe the present invention and simplify the descriptions, but are not intended to indicate or imply that the indicated device or element shall have a specific orientation or be formed and operated in a specific orientation, and therefore cannot be understood as a limitation to the present invention.

In addition, the terms such as "first" and "second" are merely intended for a purpose of description, and shall not be understood as an indication or implication of relative importance or implicit indication of a quantity of indicated technical features. Therefore, the features defined with "first" and "second" can explicitly or implicitly include at least one of the features. In the description of the present invention, "a plurality of" means at least two, for example, two or three, unless otherwise specifically defined.

Figure 2:
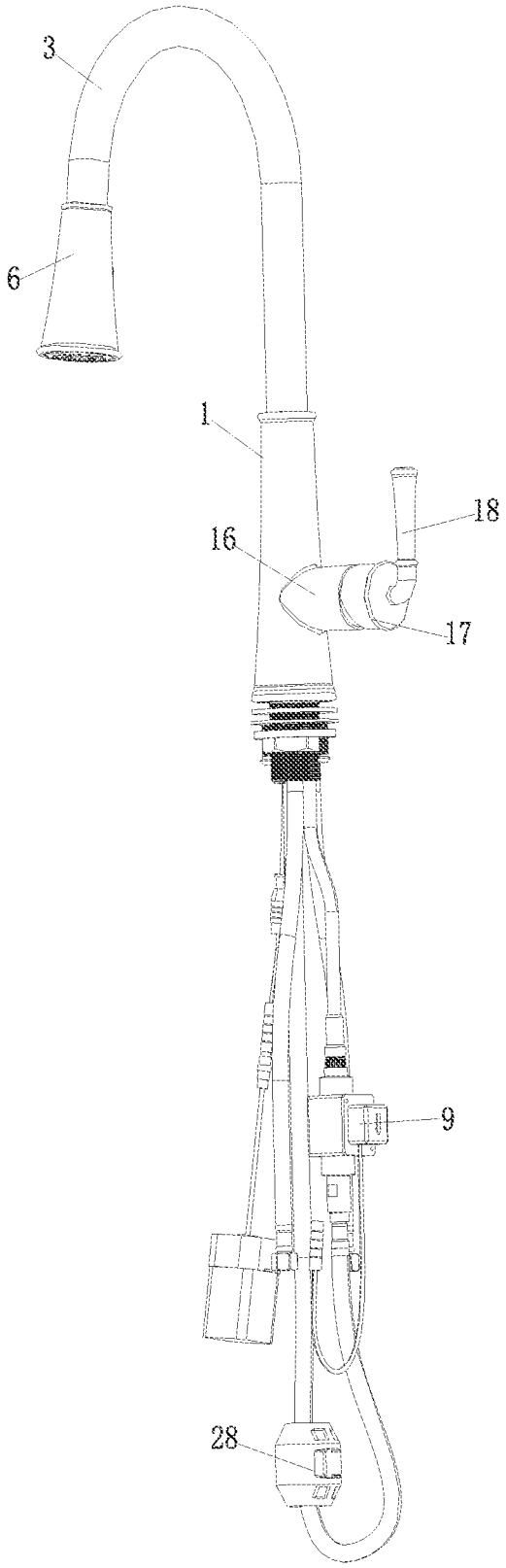
FIG. 2 is a perspective view of the present invention.
Figure 3:
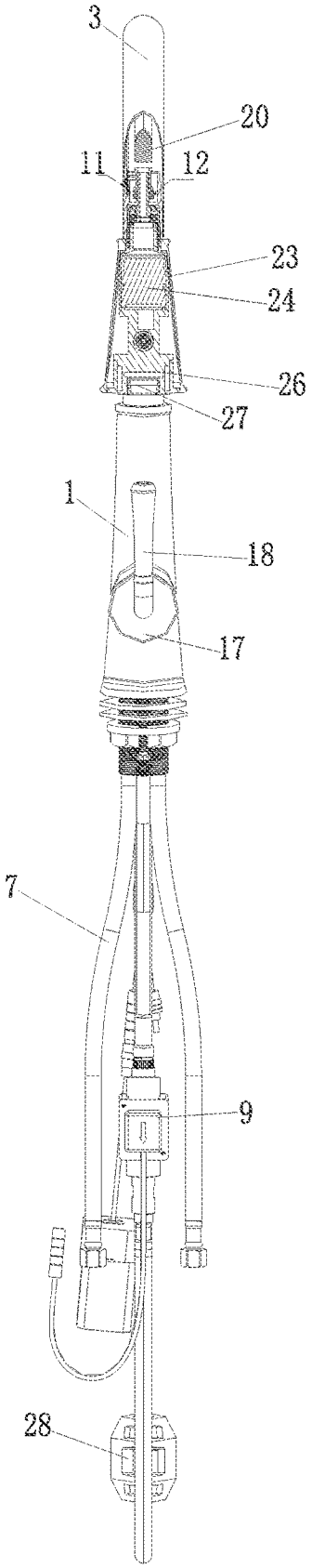
FIG. 3 is a cross-sectional view of another angle of the present invention.

As shown in FIG. 1, in the cross-sectional view of the present invention, it can be seen from FIG. 1, FIG. 2 and FIG. 3 that an induction type pulling faucet includes a faucet body, a valve core 4, a handle 5, and a pulling shower head 6. A water inlet tube 7, a pulling tube 8, and an induction control valve 9 are mounted in the faucet body. The pulling tube 8 is connected to the pulling shower head 6 and the valve core 4, respectively. The valve core 4 is connected to the water inlet tube 7 and the handle respectively. An infrared sensor 10 and a magnetic sensor 11 are mounted in the faucet body. A strong magnet 12 is mounted in the pulling shower head 6. The induction control valve 9 is connected to the water inlet tube 7 and the pulling tube 8, respectively. The infrared sensor 10 and the magnetic sensor 11 are both electrically connected to the induction control valve 9 via an electric wire 30. As can be understood, the faucet body, the handle 5, the pulling shower head 6, the water inlet tube 7 can all be made of a stainless steel material or an aluminum alloy material. The valve core 4 can be a universal valve core. The induction control valve 9 can be a solenoid valve, or the like. The induction control valve can be configured to control a water path in the water inlet tube 7 to be opened or closed according to induction signals of the infrared sensor 10 and the magnetic sensor 11. The electric wire 30 can be a universal energized cable or the like. The infrared sensor 10 can be a universal infrared sensor or the like for identifying a user close to the faucet body, thereby sending the induction signals to the induction control valve 9 to control water outlet. A cover magnetic sensor 11 can be a universal magnetic sensor or the like for identifying a change in a magnetic field caused by a change in a position of the strong magnet 12, thereby sending the induction signals to the induction control valve 9 to control the water outlet.

Specifically, the faucet body includes a faucet main body 1, a connector 2, and an elbow tube portion 3. An upper end of the faucet main body 1 is connected to the elbow tube portion 3 via the connector 2. A flat spacer 13 and a tooth tube 14 are sleeved at an outer side of a bottom of the faucet main body 1 sequentially. An infrared induction window 15 is arranged at a front end of the faucet main body 1. The infrared sensor 10 is mounted in the infrared sensing window 15. A valve core seat 16 is arranged on the faucet main body 1. The valve core 4 is mounted in the valve core seat 16. The handle 5 includes a handle seat 17 and a handle rod 18. The handle rod 18 is mounted on the handle seat 17. The handle rod 17 is connected to the valve core 4 for controlling the opening or closing of the valve core 4. An elbow tube port 19 is arranged on the elbow tube portion 3. The magnetic sensor 11 is mounted in the elbow tube port 19. The pulling tube 8 includes a pulling braided tube 20, a pulling tube inner connector 21, and a pulling tube universal head 22. The pulling tube inner connector 21 is connected to the pulling braided tube 20 and the pulling tube universal head 22, respectively. The strong magnet 12 is mounted on a pulling tube inner connector 21. The pulling shower head 6 includes a shower head upper cover 23, a hydraulic generator 24, a shower head switching valve 25, a shower head water outlet cover 26, and a mesh tip 27. The shower head cover 23 is connected to the pulling tube universal head 22. The hydraulic generator 24, the shower head switching valve 25, and the shower head water outlet cover 26 are mounted in the shower head upper cover 23 sequentially. The mesh tip 27 is mounted on an inner side of the shower head water outlet cover 26. A gravity ball 28 is sleeved on an outer side of a bottom end of the pulling tube 8. A pulling rubber sleeve 29 is arranged on an inner side of the faucet main body 1. The hydraulic generator 24 is electrically connected to the infrared sensor 10, the magnetic sensor 11, and the induction control valve 9 via the electric wire, respectively. It can be understood that a connection position of the water inlet tube 8 as well as the valve core 4 and the induction control valve 9 can be divided into a first water inlet tube and a second water inlet tube for controlling water inlet. A connection position of the pulling tube 8 as well as the valve core 4 and the induction control valve 9 can be divided into a first water outlet tube and a second water outlet tube, respectively, for controlling water outlet. The pulling shower head 6 can be pulled and pressed on an inner side of the elbow tube port 19 via a heavy vertical block on the pulling tube 8. The strong magnet 12 is mounted at the connector of the pulling shower head 6 and the pulling tube 8, so that a relative distance between the strong magnet 12 and the magnetic sensor 11 of the elbow tube port 19 is fixed to prevent an erroneous action caused by passive lengthening of the pulling tube. The hydraulic generator 24 can be a general-purpose small hydroelectric generator or the like, for generating electricity according to flow of water flow when water comes out, which can be externally connected to an accumulator outside the electric wire, thereby providing a working power supply for the infrared sensor 10, the magnetic sensor 11, and the induction control valve 9.

It can be understood that design of the present invention is reasonable and uniquely constructed. The infrared sensor 10 is arranged to induce and identify a human body to control water outlet. Further, the magnetic sensor 11 is arranged to induce and identify a change in a magnetic field between moving distances of the magnetic sensor 11 in the pulling tube and the strong magnet 12 in the pulling shower head, thereby identifying a position of the pulling shower head 6, achieving the induction and control of a manner of the water path switch, and then controlling the water path switch of the induction type pulling faucet. Control methods are diversified. Use convenience of the induction type pulling faucet is increased. The induction type pulling faucet is more convenient to use. A blank of pulling induction control of the water path switch in the industry is filled. The user's satisfaction can be greatly improved with good experience.

The embodiments of the present invention are described in detail above in conjunction with the drawings, but the present invention is not limited to the described embodiments. For the person skilled in the art, a variety of variations, modifications, substitutions, and variations on these embodiments, without departing from the principles and spirit of the present invention, still fall within the scope of protection of the present invention.

What is claimed is:

1. An induction type pulling faucet, comprising a faucet body, a valve core, a handle, and a pulling shower head, a water inlet tube and a pulling tube being mounted in the faucet body, the pulling tube being connected to the pulling shower head and the valve core, respectively, the valve core being connected to the water inlet tube and the handle, respectively, wherein the induction type pulling faucet further comprises an induction control valve, an infrared sensor and a magnetic sensor are mounted in the faucet body, a strong magnet is mounted in the pulling shower head, the induction control valve is connected to the water inlet tube and the pulling tube, respectively, and the infrared sensor and the magnetic sensor are both electrically connected to the induction control valve via an electric wire;

wherein the pulling tube comprises a pulling braided tube, a pulling tube inner connector, and a pulling tube universal connector, the pulling tube inner connector is connected to the pulling braided tube and the pulling tube universal connector, respectively, and the strong magnet is mounted on the pulling tube inner connector; and wherein the pulling shower head comprises a shower head upper cover, a hydraulic generator, a shower head switching valve, a shower head water outlet cover, and a mesh tip, the shower head upper cover is connected to the pulling tube universal head, the hydraulic generator, the shower head switching valve, and the shower head water outlet cover are mounted in the shower head upper cover sequentially, and the mesh tip is mounted at an inner side of the shower head water outlet cover.

2. The induction type pulling faucet according to claim 1, wherein the faucet body comprises a faucet main body, a connector, and an elbow tube portion, an upper end of the faucet main body is connected to the elbow tube portion via the connector, and a flat spacer and a tooth tube are sleeved on an outer side of a bottom of the faucet main body sequentially.

3. The induction type pulling faucet according to claim 2, wherein an infrared induction window is arranged at a front end of the faucet main body, the infrared induction sensor is mounted in the infrared induction window, a valve core seat is arranged on the faucet main body, the valve core is mounted in the valve core seat, and the handle comprises a handle seat and a handle rod.

4. The induction type pulling faucet according to claim 2, wherein an elbow tube port is arranged on the elbow tube portion, and the magnetic sensor is mounted in the elbow tube port.

5. The induction type pulling faucet according to claim 2, wherein a gravity ball is sleeved on an outer side of a bottom end of the pulling tube, and a pulling rubber sleeve is arranged at an inner side of the faucet main body.

6. The induction type pulling faucet according to claim 1, wherein the hydraulic generator is electrically connected to the infrared sensor, the magnetic sensor, and the induction type control valve via the electric wire, respectively.

* * * * *